US007377269B1

(12) United States Patent
Lai

(10) Patent No.: US 7,377,269 B1
(45) Date of Patent: May 27, 2008

(54) AUTOMOBILE FUEL SAVER

(75) Inventor: Chieh-Jung Lai, Younghe (TW)

(73) Assignee: Pottery Trading USA, Inc., San Diego, CA (US)

( * ) Notice: Subject to any disclaimer, the term of this patent is extended or adjusted under 35 U.S.C. 154(b) by 0 days.

(21) Appl. No.: 11/647,442

(22) Filed: Dec. 29, 2006

(51) Int. Cl.
*F02M 27/00* (2006.01)

(52) U.S. Cl. ..... 123/538

(58) Field of Classification Search ..... 123/536–538
See application file for complete search history.

(56) References Cited

U.S. PATENT DOCUMENTS

2005/0241626 A1* 11/2005 Hashimoto et al. ..... 123/538
2007/0074683 A1* 4/2007 Matsuo et al. ..... 123/41.01
2007/0163552 A1* 7/2007 Kitajima et al. ..... 123/538

* cited by examiner

*Primary Examiner*—M. McMahon
(74) *Attorney, Agent, or Firm*—Troxell Law Office, PLLC

(57) ABSTRACT

An automobile fuel saver is composed of a container, a magnetic block, a plurality of nano far-infrared pellets and a cover, wherein the container is configured with an opening that enables a magnetic block and a plurality of the nano far-infrared pellets to be disposed into the container therethrough, and the cover is used to cover and seal the opening. Such a configuration enables a user to use connecting rods to respectively screw into screw holes defined in the cover to juxtapose and assemble a plurality of the fuel savers. The assembled composite structure of the fuel savers is disposed into a fuel tank to effectively improve automobile performance, decrease fuel consumption, and reduce exhaust discharge while simultaneously increasing horsepower and torsion.

5 Claims, 9 Drawing Sheets

AUTOMOBILE FUEL SAVER

BACKGROUND OF THE INVENTION (a) Field of the Invention

The present invention relates to a structure of an automobile fuel saver and a juxtaposed composite configuration thereof, in which a fuel saver dropped into a fuel tank is able to firmly attach to the bottom of the fuel tank. Moreover, a plurality of the fuel savers can be mutually assembled together according to the frequency of displacement of the automobile by the user, thereby providing effectiveness to improve automobile performance, including increase of horsepower and torsion, and decrease of fuel consumption and waste gas discharge.

(b) Description of the Prior Art

Automobiles have become extremely convenient means of transport that utilize a fuel engine adopting petroleum refined products as the power unit for driving purposes, wherewith fuel is caused to enter the engine, whereupon a fuel and air mixture undergoes atomization and then ignition or compression explosion to produce energy for motion. However, incomplete combustion of the liquid fuel often results in carbon deposition formed on the inner walls of the cylinders, and once an excessive amount of carbon deposition has formed on the inner walls of the cylinders, incomplete combustion results in discharge of exhaust gas containing an excessive amount of suspended particles, causing environmental pollution, which also affects engine output energy effectiveness, and produces serious abrasion in the engine. Numerous methods are currently adopted to solve such problems, such as addition of a combustion improver, or the use of decarbonizing agents, and so on. However, among the multitudinous fuel saver devices, far-infrared fuel savers have received the most attention.

Regarding method of application, the majority of known far-infrared fuel savers in the current market may be roughly divided into two types, one type fixes the fuel saver on the intake pipe, and the penetrating power of the far-infrared rays emanating from the fuel saver is used to disseminate the far-infrared rays to the liquid fuel in the intake pipe and micronize molecules in the fuel, thereby enabling a more complete combustion of the liquid fuel, and thus preventing carbon deposition from occurring. The other type involves dropping the fuel saver directly into the fuel tank, thereby enabling the fuel saver to function directly on the fuel in the fuel tank, and thus improve activation of the fuel molecules.

However, regarding the two aforementioned methods of application, the second type provides better effectiveness in use, and is better able to effectively improve automobile performance, decrease oil consumption, reduce discharge of exhaust gas and, furthermore, strengthen horsepower and torsion effectiveness. However, this method drops the fuel saver directly into the fuel tank, and because fuel-tank capacity varies depending on vehicle type, thus the efficiency produced by the fuel saver is affected. Hence, there is a need for improvement so as to accommodate various vehicle models and user requirements.

Furthermore, while automobile engine models vary, taking a small passenger car as example, a relatively small fuel tank is sufficient for small cylinders to cope with long distance travel, whereas the fuel tank of a general truck or bus is relatively large, and thus there is the necessity for a structural series connection of fuel savers. Accordingly, structure of a fuel saver proposed in the present invention enables assembly of a composite structure of a plurality of fuel savers.

SUMMARY OF THE INVENTION

A primary objective of the present invention is to provide an automobile fuel saver which is able to firmly attach to the bottom of the fuel tank of various models of vehicles to realize its effectiveness.

Another objective of the present invention is to provide an automobile fuel saver which enables a user to juxtapose and assemble a composite structure of a plurality of the fuel savers according to that required by the vehicle model of the user to realize maximum effectiveness, and effectively improve automobile performance, decrease oil consumption, reduce discharge of exhaust gas while simultaneously enhancing automobile horsepower and torsion.

In order to achieve the aforementioned objectives, the automobile fuel saver of the present invention is structured to comprise a container, a magnetic block, a plurality of nano far-infrared pellets and a cover, wherein one end of the container is configured with an opening, which enables a magnetic block to be disposed in a holding vessel at a bottom portion of the container therethrough, a plurality of the nano far-infrared pellets are packed into the container, and the cover is used to cover and seal the opening. Such a configuration enables the fuel saver to be dropped into a fuel tank, whereupon the magnetic block disposed in the interior of the fuel saver firmly attaches to the bottom of the fuel tank. Far-infrared rays released by the nano far-infrared pellets are used to realize decomposition and realignment of fuel molecules, hereby improving activation of the fuel molecules, effectively improving automobile performance, decreasing fuel consumption, reducing exhaust discharge while simultaneously increasing horsepower and torsion.

Furthermore, when series connecting a plurality of the automobile fuel savers, adapter ends respectively provided at two ends of the cover are used to enable containers to be simultaneously and respectively locked onto the two ends. A plurality of screw holes are defined in a circumferential ring of the cover end, which enable connecting rods to respectively screw therein and juxtapose and assemble together a plurality of the fuel savers. Hence, a user is able to freely series connect a plurality of the fuel savers according to individual requirement, and thereby configuring a composite structure of the fuel savers.

To enable a further understanding of said objectives and the technological methods of the invention herein, brief description of the drawings is provided below followed by detailed descriptions of the preferred embodiments.

DETAILED DESCRIPTION OF THE PREFERRED EMBODIMENTS

Figure 1:
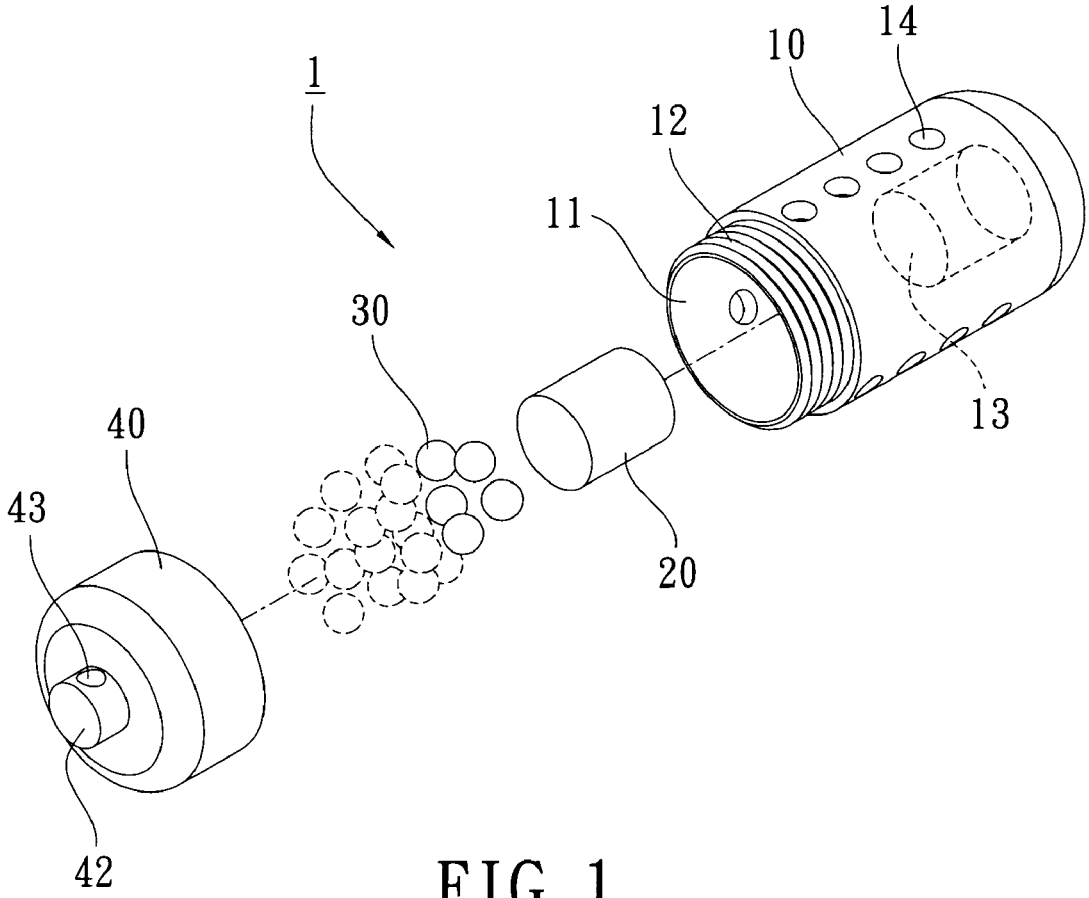
FIG. 1 shows an exploded view of a fuel saver according to the present invention.
Figure 2:
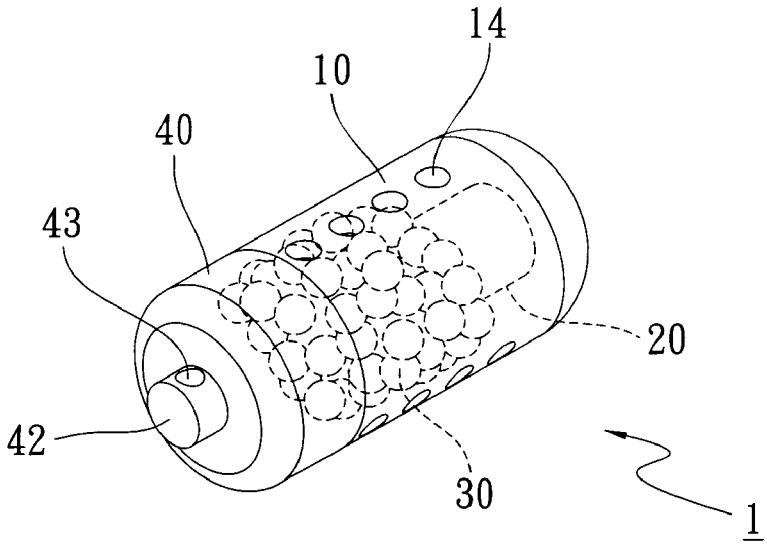
FIG. 2 shows a perspective view of the fuel saver according to the present invention.
Figure 3:
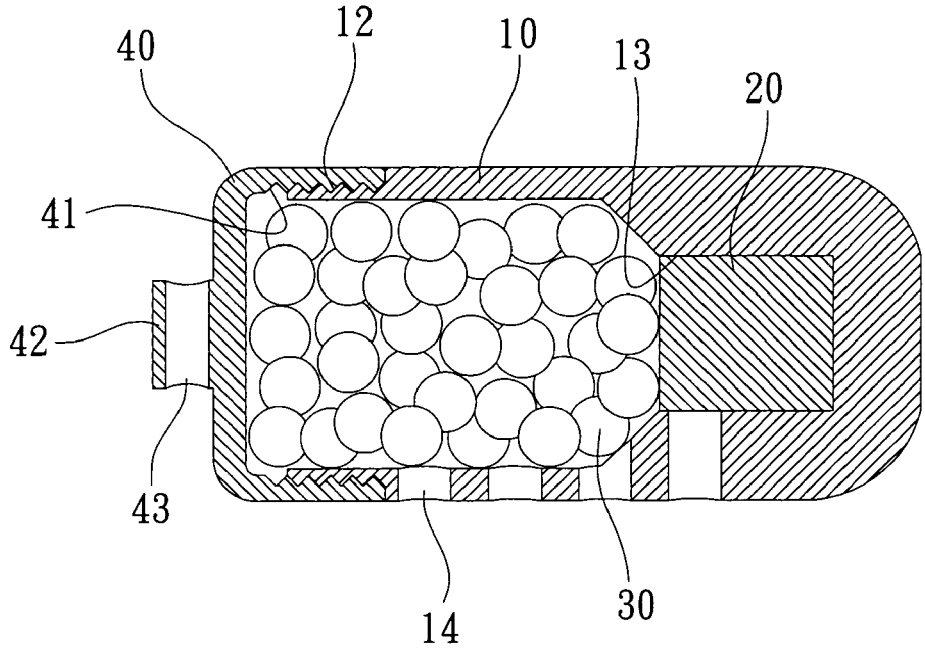
FIG. 3 shows a cut-away view of the fuel saver according to the present invention.

Referring to FIGS. 1~3, which show a structure of a fuel saver 1 of the present invention, structured to comprise a container 10, a magnetic block 20, a plurality of nano far-infrared pellets 30 and a cover 40. One end of the container 10 is configured with an opening 11, a fringe of which is provided with an external screw thread 12, and a bottom portion of the container 10 is provided with a holding vessel 13. Moreover, a plurality of perforations 14 are defined on the circumference of the container 10. The magnetic block 20 is disposed in the holding vessel 13 at the bottom portion of the container 10 through the aforementioned opening 11, and the plurality of nano far-infrared pellets 30 are packed within the container 10.

An internal screw thread 41 is defined on an inner edge of the cover 40 (see FIG. 3) to enable the cover 10 to screw onto the aforementioned external screw thread 12 on the opening 11, thereby sealing and structuring the fuel saver 1. Furthermore, a top end of the cover 40 is provided with a protruding piece 42, and a through hole 43 is defined in a side edge thereof, which enables a hook or suspending thread to be joined thereto to facilitate lifting the fuel saver device out from an engine fuel tank after placing therein.

Figure 5:
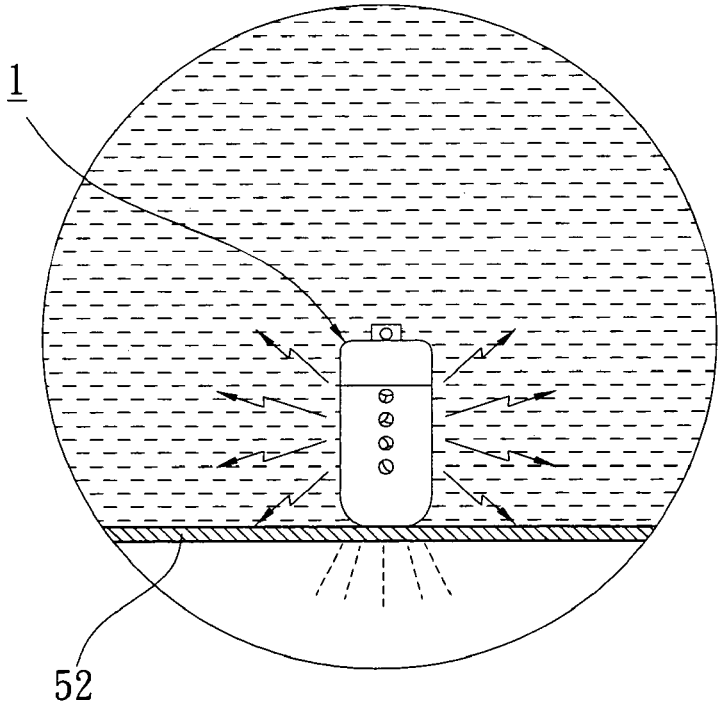
FIG. 5 shows an enlarged schematic view depicting the fuel saver disposed in a fuel tank according to the present invention.
Figure 4:
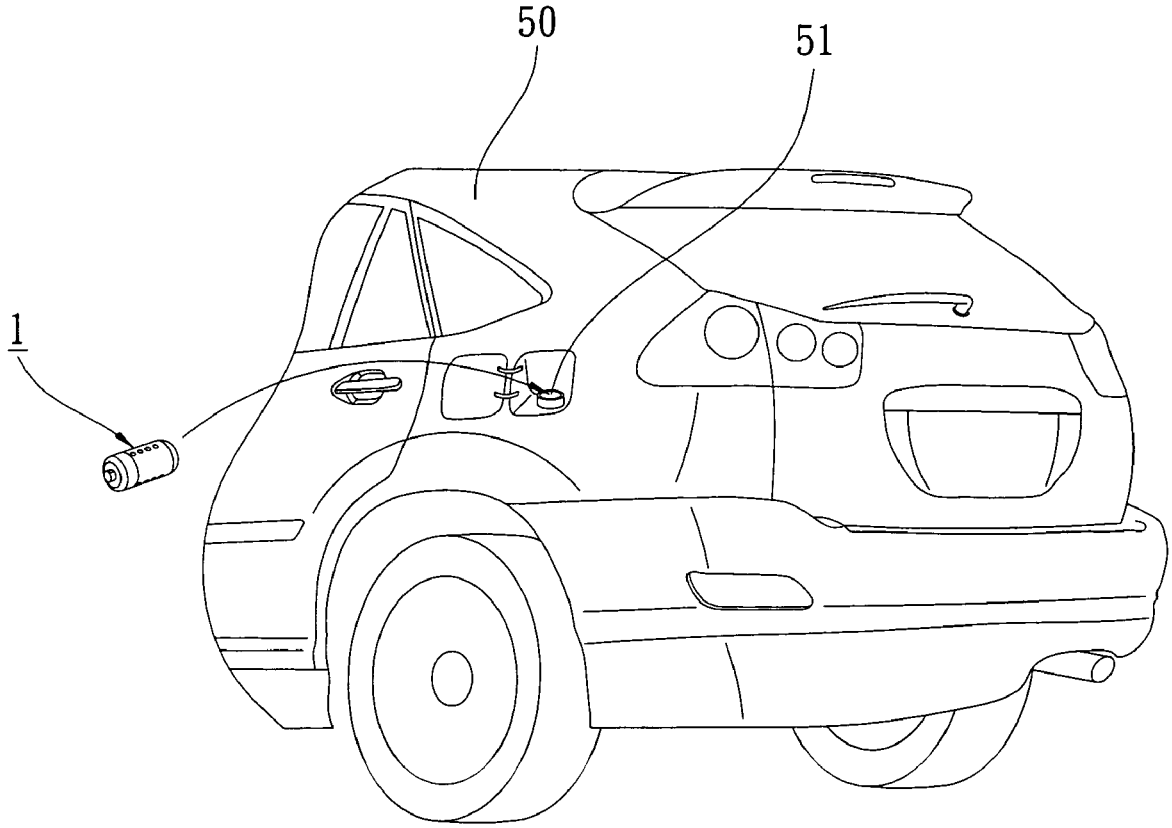
FIG. 4 shows a schematic view depicting an example of implementation of the fuel saver according to the present invention.

Referring to FIGS. 4 and 5, when the present invention is in use, the fuel saver 1 is dropped into a fuel tank 52 through a filling aperture of an automobile 50, or disposed into the fuel tank 52 through a hole defined on a fuel gage interior of the automobile 50, thereby submerging the fuel saver 1 to the bottom of the fuel tank 52, whereupon the magnetic block 20 disposed in the interior of the fuel saver 1 enables firm attachment to the bottom of the fuel tank 52, and prevents the fuel saver 1 from freely rolling along with the swaying motion of the fuel in the fuel tank 52. Moreover, far-infrared rays having intense permeability and fast penetrability released by the nano far-infrared pellets 30 within the container 10 effect fuel molecules within the fuel tank 52, improving activation of fuel molecules and realizing more thorough fuel combustion efficiency, thereby improving combustion efficiency of the engine, increasing automobile performance and enabling effortless accelerator response.

There are no limitations on depth and external form of the holding vessel 13, which may be designed with a substantially vertical extent, and two or three of the magnetic blocks 20 may be disposed together in the holding vessel 13, thereby increasing magnetic intensity.

Figure 6:
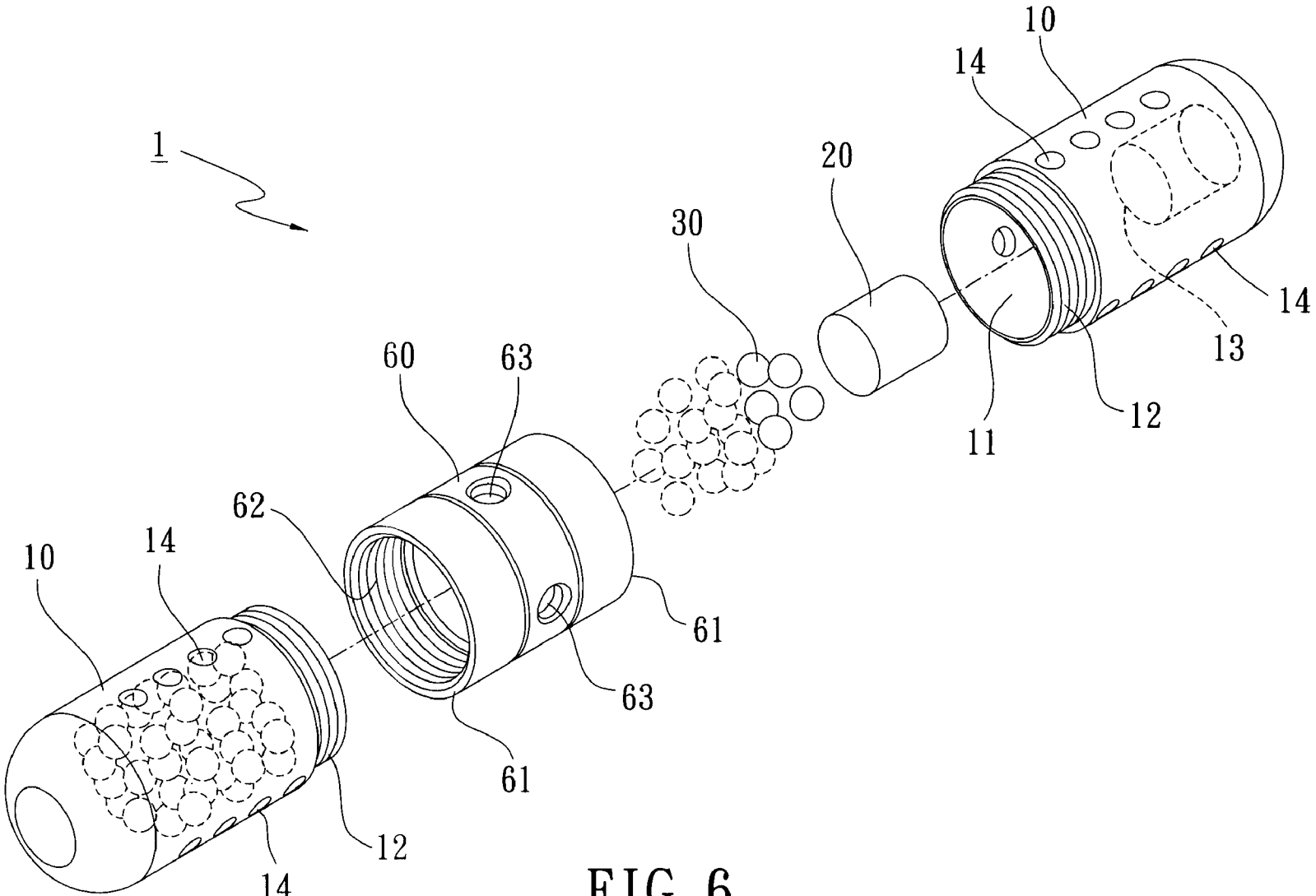
FIG. 6 shows an exploded view of another embodiment according to the present invention.
Figure 7:
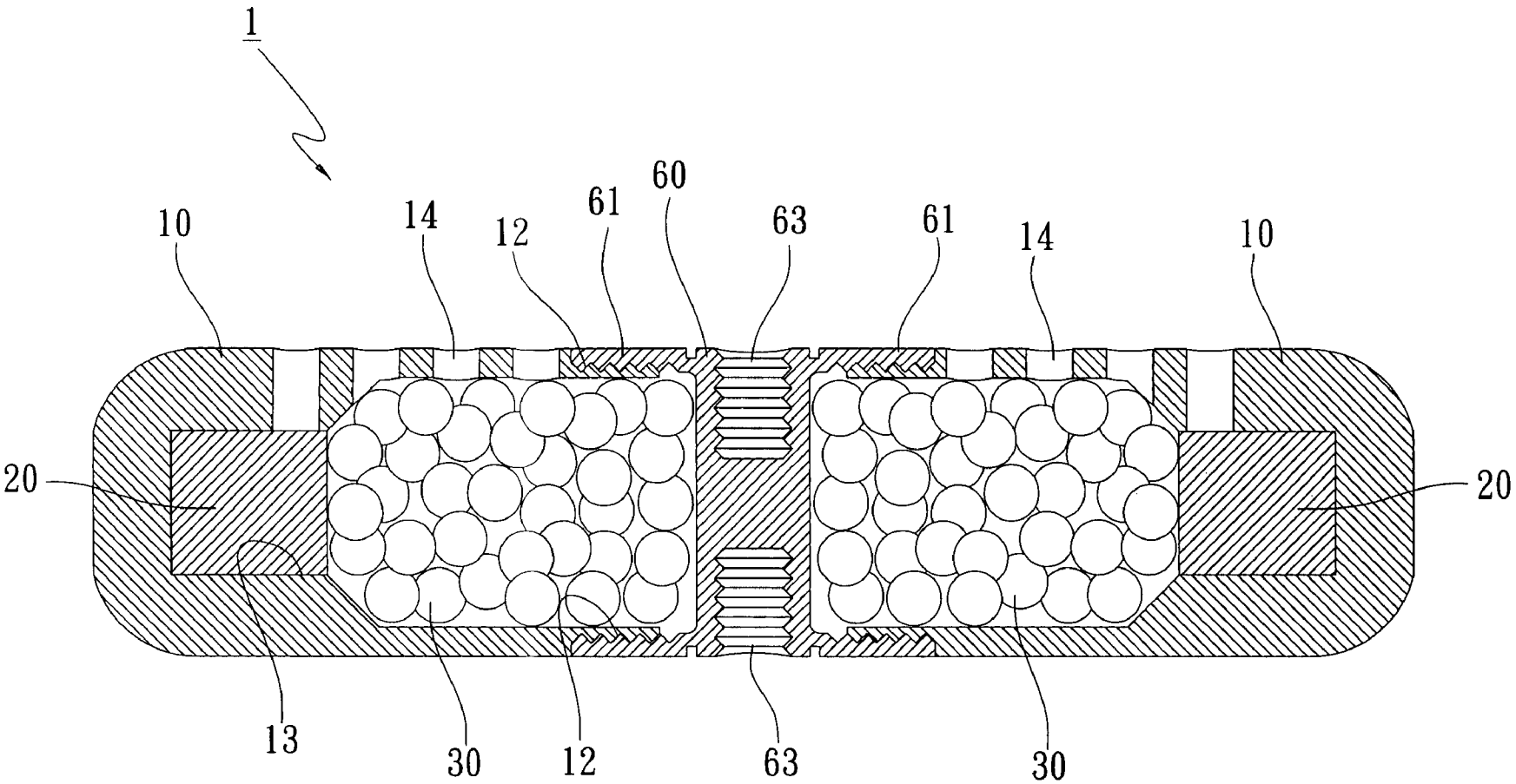
FIG. 7 shows a cut-away view of the embodiment of FIG. 6.
Figure 8:
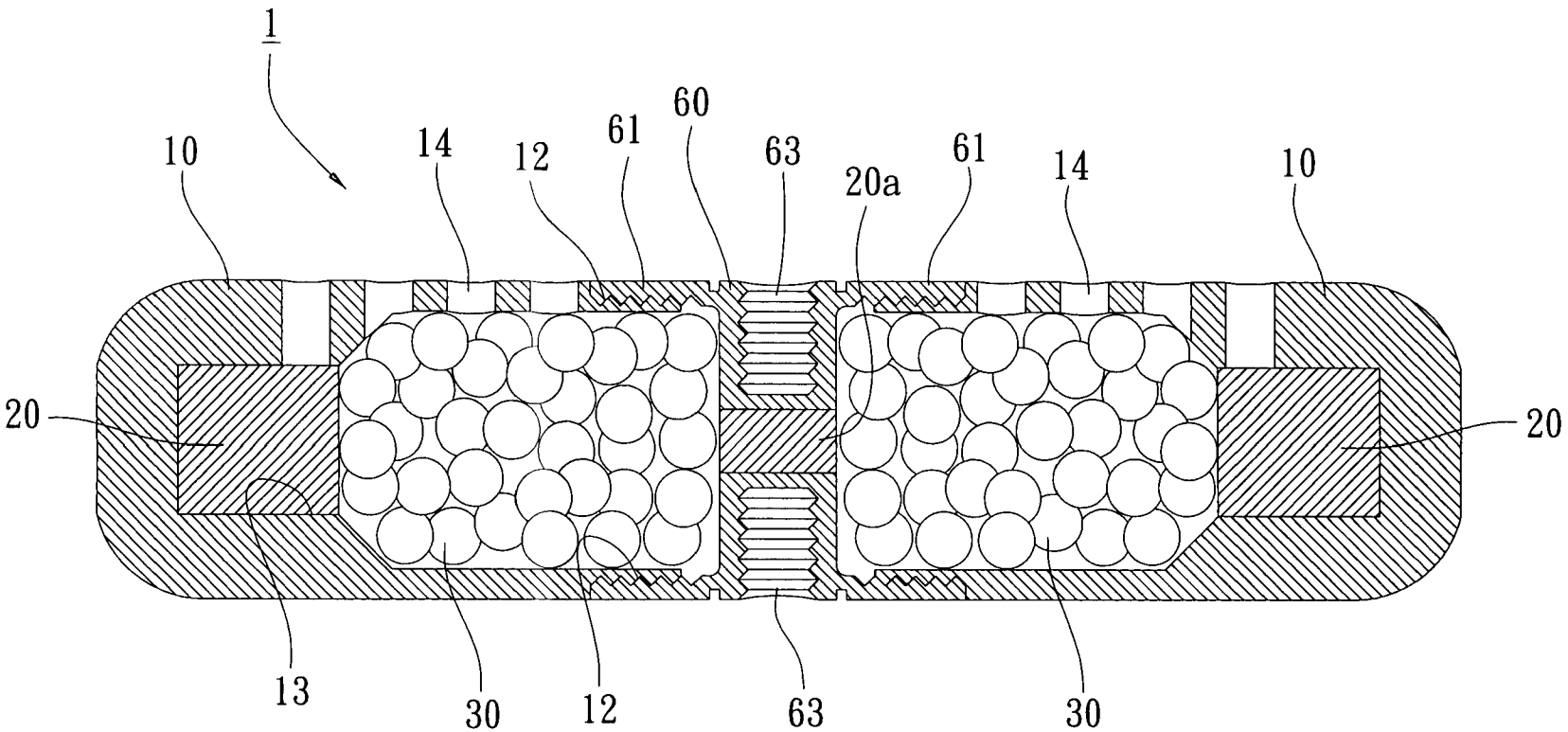
FIG. 8 shows a cut-away view of the embodiment with the additional disposition of a magnetic block in a cover according to the present invention.

Referring to FIGS. 6~8, which show a composite structure of the fuel saver 1, wherein a cover is structured to form an adapter mount 60, and the containers 10 are respectively joined to two ends of the adapter mount 60. Interior of each of the containers 10 is respectively fitted with the magnetic blocks 20 and a plurality of the nano far-infrareds pellets 30. Adapter ends 61 are respectively located at the two ends of the adapter mount 60 to enable the containers 10 to be respectively joined thereto, and internal screw threads 62 are respectively defined on inner edges of the adapter ends 61. Moreover, a plurality of screw holes 63 are defined on a circumferential ring of the adapter mount 60, the external screw thread 12 is configured on a fringe of each of the openings 11 defined at one end of each of the containers 10, and the holding vessels 13 are respectively located at the bottom portion within the respective containers 10. Furthermore, the plurality of perforations 14 are defined on the circumference of each of the containers 10. The magnetic blocks 20 are respectively disposed into the bottom portion of the holding vessels 13 through the aforementioned openings 11, and then a plurality of the nano far-infrared pellets 30 are packed within the containers 10, and the external screw threads 12 at the ends of the openings 11 are respectively screwed into the internal screw threads 62 of the aforementioned adapter mount 61, thereby sealing and assembling the composite structure of the fuel saver 1. In addition, a slot may be defined as interior of the adapter mount 60, thereby enabling a magnetic block 20*a* to be additionally disposed therein, and thus strengthening the magnetic intensity of the entire fuel saver 1 (see FIG. 8).

Figure 9:
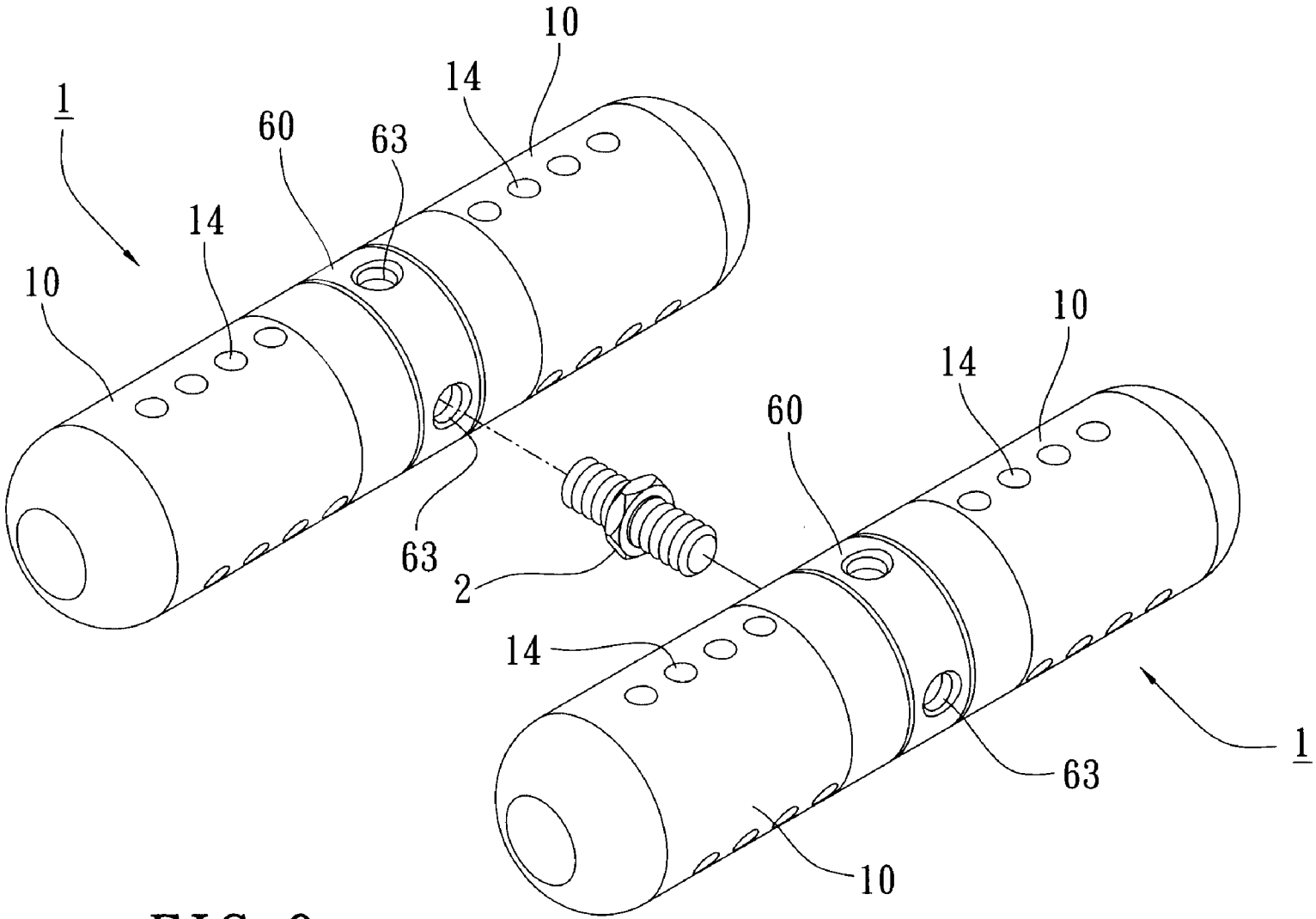
FIG. 9 shows an exploded view of a juxtaposed structure of two of the fuel savers according to the present invention.
Figure 10:
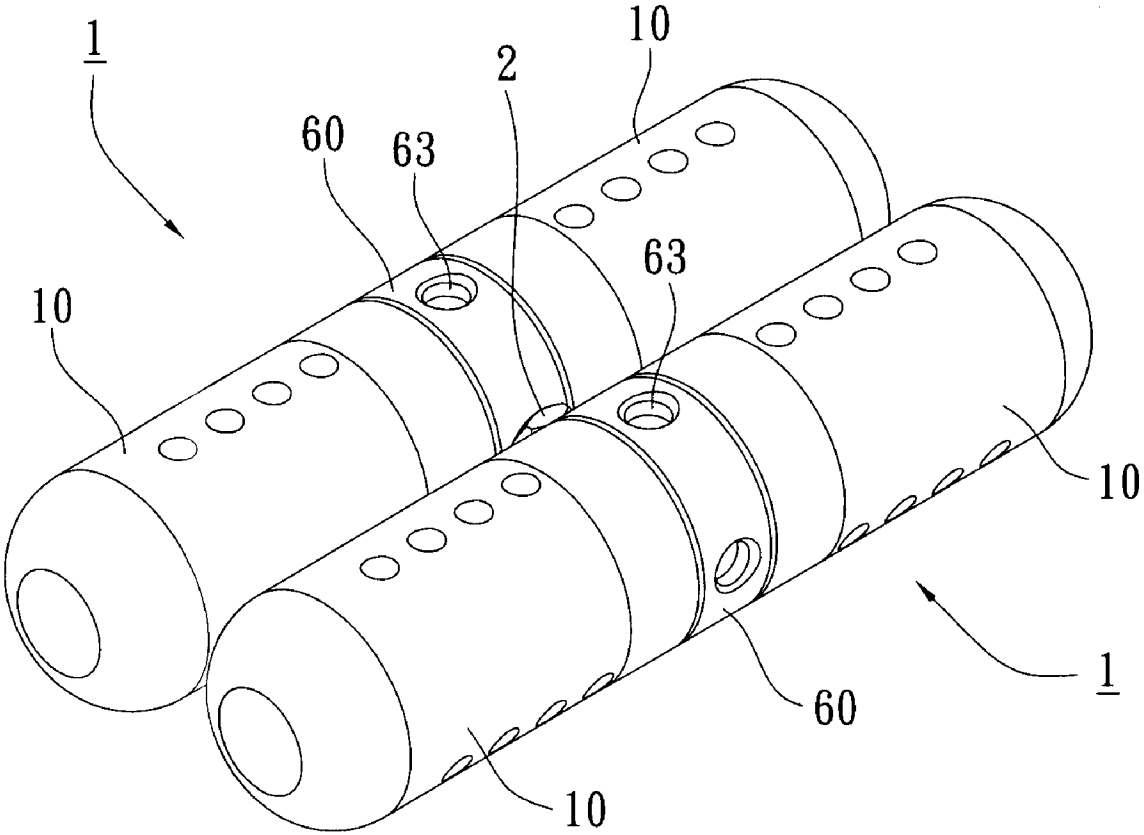
FIG. 10 shows a perspective view after assembling two of the fuel savers according to the present invention.
Figure 11:
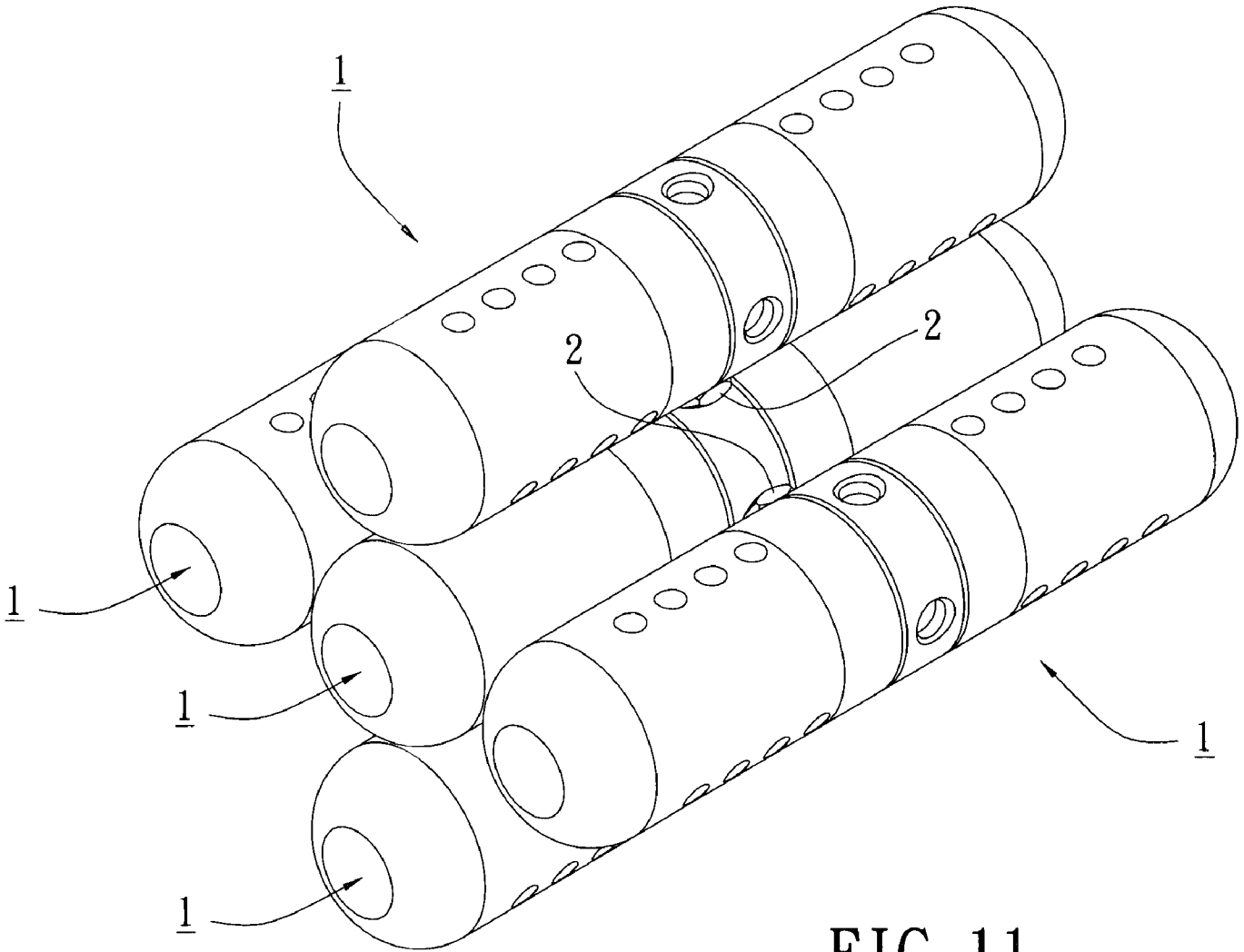
FIG. 11 shows a perspective view after assembling a plurality of the fuel savers according to the present invention.

Referring to FIGS. 9~11, according to capacity of the fuel tank or individual requirements, a user may use the single fuel saver 1, or connecting rods 2 can be respectively screwed into the respective screw holes 63 on the circumferences of the adapter mounts 60 to mutually juxtapose and assemble a plurality of the fuel savers 1. The single fuel saver 1 can be dropped into a fuel tank through the automobile filling aperture, or a series assembly of a plurality of the fuel savers 1 can be disposed into the fuel tank through a hole of a fuel gage device, thereby submerging the fuel saver 1 to the bottom of the fuel tank, whereupon the magnetic blocks 20 disposed in the interior of the fuel savers 1 enable firm attachment to the bottom of the fuel tank, and prevents the fuel savers 1 from freely rolling along with the swaying motion of the fuel in the fuel tank. Moreover, far-infrared rays having intense permeability and fast penetrability released by the nano far-infrared pellets 30 within the containers 10 effect fuel molecules within the fuel tank, raising molecular activity and realizing more thorough fuel combustion efficiency, thereby improving combustion efficiency of the engine, increasing automobile performance and enabling effortless accelerator response.

There are no limitations on depth and external form of the holding vessels 13, which may be designed with a substantially vertical extent, and two or three of the magnetic blocks 20 may be disposed together in each of the holding vessels 13, thereby increasing magnetic intensity.

It can be known from the above descriptions that the fuel saver device of the present invention has the following practical advantages:

1. Disposition of the fuel saver 1 in the fuel tank of an automobile enables direct exposure between the nano far-infrared pellets and the fuel, thereby realizing maximum effectiveness, and thus effectively improving automobile performance.

2. It enables a user to freely juxtapose and assemble a composite structure of a plurality of the fuel savers 1 according to different requirements, thereby facilitating use in large fuel tanks.

3. Use of the magnetic blocks 20 disposed within the containers 10 enables the fuel savers 1 to firmly attach to the bottom portion of the automobile fuel tank, which is extremely convenient to use and safe.

In conclusion, the present invention is providing a fuel saver composite structure applicable for use in various vehicle models, and is able to accommodate user requirements, and assuredly achieves anticipated objectives, and practicability and advancement of the present invention clearly comply with essential elements as required for a new patent application. Accordingly, a new patent application is proposed herein.

It is of course to be understood that the embodiments described herein are merely illustrative of the principles of the invention and that a wide variety of modifications thereto may be effected by persons skilled in the art without departing from the spirit and scope of the invention as set forth in the following claims.

What is claimed is:

1. An automobile fuel saver, comprising a container, a magnetic block, a plurality of nano far-infrared pellets and a cover, wherein a plurality of perforations are defined on a circumference of the container, one end of the container is configured with an opening, and a bottom portion of the container is provided with a holding vessel, which enables the magnetic block to be disposed therein through the opening; moreover, the plurality of nano far-infrared pellets are packed within the container, and the cover covers and seals the opening.

2. The automobile fuel saver according to claim 1, wherein a fringe of the opening of the container is configured with an external screw thread and an inner edge of the cover is configured with an internal screw thread, thereby enabling the cover to be screwed onto the container.

3. The automobile fuel saver according to claim 1, wherein a protruding piece is located on a top end of the cover, and a through hole is defined in a side edge of the protruding piece.

4. The automobile fuel saver according to claim 1, wherein two ends of the cover are respectively provided with an adapter end, thereby enabling two of the containers to be respectively joined to each end of the cover, a plurality of screw holes are defined on a circumferential ring of the cover, and connecting rods are used to respectively screw into the screw holes to enable juxtaposing and assembling a plurality of the fuel savers.

5. The automobile fuel saver according to claim 1, wherein internal screw threads are respectively defined on inner edges of the adapter ends, and the external screw thread configured on the opening of each of the containers enables the containers to be respectively screwed into the internal screw threads of the adapter ends.

* * * * *